United States Patent [19]

Shishkin et al.

[11] Patent Number: 4,841,843

[45] Date of Patent: Jun. 27, 1989

[54] DEVICE FOR CONVERTING ENERGY OF FLUID MEDIUM INTO MECHANICAL WORK

[76] Inventors: Viktor V. Shishkin, ulitsa Festivalnaya, 16, kv. 5; Nikolai F. Kryazhevskikh, ulitsa Krasnykh Partizan, 559, kv. 13; Jury P. Shapovalov, ulitsa Turgeneva, 18, all of Krasnodar, U.S.S.R.

[21] Appl. No.: 112,566

[22] PCT Filed: Dec. 17, 1986

[86] PCT No.: PCT/SU86/00135

§ 371 Date: Jul. 27, 1987

§ 102(e) Date: Jul. 27, 1987

[87] PCT Pub. No.: WO87/03940

PCT Pub. Date: Jul. 2, 1987

[30] Foreign Application Priority Data

| | | | |
|---|---|---|---|
| Dec. 24, 1985 | [SU] | U.S.S.R. | 3988766 |
| Dec. 24, 1985 | [SU] | U.S.S.R. | 3988772 |
| Dec. 24, 1985 | [SU] | U.S.S.R. | 3988770 |
| Dec. 24, 1985 | [SU] | U.S.S.R. | 3988775 |

[51] Int. Cl.[4] ..... F15B 13/044

[52] U.S. Cl. ..... 91/459; 91/1; 92/48; 92/64; 92/68; 92/98 D

[58] Field of Search ..... 92/48, 64, 50, 69, 75, 92/32, 72, 98 D, 89, 136; 91/534, 1, 275, 459, 508

[56] References Cited

U.S. PATENT DOCUMENTS

| | | | |
|---|---|---|---|
| 3,229,590 | 1/1966 | Huska | 92/48 |
| 3,471,668 | 11/1967 | Wilkes | 92/89 |
| 4,616,556 | 10/1986 | Meilman et al. | 92/48 |

FOREIGN PATENT DOCUMENTS

| | | | |
|---|---|---|---|
| 0608076 | 12/1978 | Switzerland | 92/48 |
| 0703680 | 12/1979 | U.S.S.R. . | |
| 0861727 | 9/1981 | U.S.S.R. . | |
| 0885640 | 11/1981 | U.S.S.R. . | |
| 0918590 | 4/1982 | U.S.S.R. . | |
| 0937801 | 6/1982 | U.S.S.R. . | |
| 1097822 | 10/1982 | U.S.S.R. . | |

*Primary Examiner*—Robert E. Garrett
*Assistant Examiner*—Thomas Deniow
*Attorney, Agent, or Firm*—Burgess, Ryan & Wayne

[57] ABSTRACT

A device for converting energy of a fluid medium into mechanical work comprises a hermetically sealed chamber (1) communicated through valves with systems for supply and discharge of a fluid medium. The chamber has an opening (4) in which a sleeve (5) of flexible material is secured through one end along the perimeter, the sleeve being mounted in the chamber (1) with a possibility of reciprocation relative to the secured end so that during the motion from the initial position to the extreme position a part of the sleeve (5) is turned inside out forming a space (9) communicating with the chamber (1). The sleeve (5) through its other end is connected to a drum (7) disposed in the chamber (1) and mounted on a shaft (6) coupled to a reverser (11) through an overrunning clutch (8). In the initial position the sleeve (5) is wound on the drum (7).

8 Claims, 3 Drawing Sheets

DEVICE FOR CONVERTING ENERGY OF FLUID MEDIUM INTO MECHANICAL WORK

TECHNICAL FIELD

The present invention relates to volumetric displacement engines, namely: volumetric displacement engines having elastic working members. More specifically, the invention relates to devices for converting energy of a fluid medium into mechanical work.

PRIOR ART

At present, the stationary or vehicle power units are built around steam engines, steam or gas turbines, and internal combustion engines, in which the energy of a pressurized fluid medium is converted into mechanical work of an actuator. The fluid medium which is actuated by the device or actuates this device, may be gas or liquid. The devices for converting energy of a fluid medium into mechanical work comprise a hermetically sealed chamber communicating with a system for supply and discharge or the fluid medium. The chamber accommodates a reciprocating piston kinematically connected to an actuator.

A common disadvantage of the prior art devices is their low efficiency caused by high losses of energy due to friction between the piston and the chamber walls. Furthermore, in the process of operation of such devices, the effeciency drops down considerably due to wear of the piston and chamber.

It is well known that such devices also feature a complex design, since they require a cooling system and hermetic sealing of the main working components.

Their efficiency is also reduced by the fact that the piston is sealed by piston rings, which apply additional pressure to the chamber wall; therefore for moving the piston in the chamber, accessive pressure of the fluid medium is required with the result that no useful work is performed.

Also known in the art is a device for converting energy of a fluid medium into mechanical work comprising an elastic piston, in which the energy loss for friction between the chamber walls and the piston is very low (cf. SU, A, No. 861727). This device comprises a hermetically sealed chamber communicating through a control valve and a discharge valve with systems for supply and discharge of the fluid medium; the chamber has an opening, accommodating a sleeve having one end fixed along the perimeter and capable of reciprocating with respect to the fixed end so that, when moving from the initial position to the extreme position, a part of the sleeve is turned inside out forming a space; the sleeve is connected to a drum mounted on a shaft coupled to a reverser through an overrunning clutch.

The sleeve is made of two interconnected parts having different diameters. A part of the sleeve is turned inside out and its end are interconnected along the perimeter so that the sleeve forms a closed annular space. The sleeve is fixed in the opening through its part having a larger diameter. The sleeve is connected to the drum through the agency of a flexible link which is arranged along the sleeve axis, one end of the link being connected to the drum, while the other end thereof is connected to the sleeve part having a smaller diameter.

The annular space is filled with gas under pressure. In the initial position of the sleeve the link is wound on the drum, the sleeve is outside of the chamber, and the sleeve part having a smaller diameter is located outside of the annular space.

During the travel to the extreme position, due to the difference in the cross-sectional areas of the annular space formed by the parts of the sleeve having different diameters, the sleeve part having a larger diameter is turned inside out and the sleeve is pulled into the chamber.

The flexible link moves together with the sleeve and, while being unwound from the drum, rotates it. The drum torque is transmitted to the actuator. The drum is returned to its initial position by the reverser.

Thus, the torque, i.e. useful load taken from the actuator, is proportional to the product of the crosssectional area of the annular space limited by the sleeve parts having different diameters by the gas pressure in the annular space.

In spite of insignificant friction between the sleeve and the chamber walls, the efficiency of such a device for converting energy of a fluid medium into mechanical work does not exceed 10%, because during each reciprocation of the sleeve from its initial position to the extreme one and back we have "expansion-compression" of the gas in the annular space due to a change of its volume, and this results in considerable heat losses and, therefore, in low efficiency.

The power output of this device is limited by the ratio of the cross-sectional areas of the sleeve parts having different diameters and by the value of the gas pressure in the annular space. The efficiency decreases in proportion to a decrease of the gas pressure in the annular space.

The efficiency is also reduced considerably due to the fact that up to 40% of the energy stored by the actuator (made as a flywheel) is spent for bringing the sleeve back to its initial position. Therefore, the flywheel must have a large size. The size of the device is also increased significantly due to the fact that in the initial position the sleeve is outside the chamber and in its extreme position is fully accommodated by this chamber. The size is also increased due to the fact that the drum, its drive and the reverser are located outside the chamber.

The field of application of such a device for converting energy of a fluid medium into mechanical work is limited due to its complex construction and also due to low power output, which depends on the ratio of the cross-sectional areas of the sleeve parts having different diameters and on the gas pressure in the annular space.

In this prior art device only compressed gas can be used as a fluid medium.

ESSENCE OF THE INVENTION

An object of the present invention is to provide a device for converting energy of a fluid medium into mechanical work featuring an attachment of the sleeve inside the chamber which would make it possible to increase the sleeve cross-sectional area on which acts the pressure exerted by the fluid fed into the chamber, as well as the volume of the chamber, thereby enhancing the efficiency and power of the device.

This object is attained by providing a device for converting energy of a fluid medium into mechanical work comprising a hermetically sealed chamber communicating through a control valve and a discharge valve with systems for supply and removal of the fluid medium and having an opening fixed wherein along the perimeter thereof is one end of a sleeve made of a flexible material, the sleeve being capable of reciprocating with respect to the fixed end so that, when traversing from the initial position to the extreme position, a part of the sleeve is turned inside to forming a space, the sleeve being connected to a drum mounted on a shaft coupled to a reverser through an overrunning clutch, wherein according to the invention, the drum is located inside the chamber and the other end of the sleeve is connected to the drum so that in the initial position the sleeve is wound on the drum, whereas the space formed by the part of the sleeve turned inside out communicates with the chamber. In order to accelerate the removal of the fluid medium from the chamber when moving the sleeve to its initial position, it is reasonable that the device comprise a flexible link connected to the drum and to the other end of the sleeve, which in the extreme position is open, while in the initial position is wound on the drum together with the link.

It is preferable that in the devices transmitting a high load to the actuator, which feature incomplete expansion of the gas in the chamber, the reverser should comprise a group of blades arranged radially and secured at least on one end face of the drum, while the discharge valve be made as a throttle valve installed in a wall of the chamber in such a manner that the stream of the fluid medium flowing from the chamber through the throttle valve should act on the blades thus rotating the drum for winding the sleeve.

In order to provide continuous movement of the shaft, it is expedient that the device include an additional hermetically sealed chamber communicating with the control valve, in which chamber an additional sleeve of an electric material be mounted, similarly to the main sleeve, so that in the extreme position of the main sleeve the additional sleeve should be in its initial position and wound on an additional drum mounted on the same shaft, on which the main drum is mounted.

To provide reversible rotation of the shaft, it is exedient that the main and additional drums be rigidly interconnected, whereas the main and additional sleeves in their initial position be wound on the corresponding drums in opposite directions.

To provide rotation of the shaft in a signal direction, it is advantageous that the main drum be mounted on the shaft by means of an overrunning clutch, while the device should include an additional overrunning clutch, through which said additional drum be mounted on the shaft, whereas the reverser should comprise two spools rigidly secured on the main and additional drums coaxially therewith, and a flexible link having its ends secured on the spools, and wound on the spool secured on the drum connected to the sleeve which is in its extreme position, and the main and additional sleeves in their initial position be wound in the same direction.

Such a design of devices for converting energy of a fluid medium into mechanical work makes it possible to increase the efficiency at least twice as much, since the useful load taken from the actuator is in direct proportion to the product of the entire cross-sectional area of the annular space formed by the sleeve by the pressure of the fluid medium in the chamber. The power output of such a device can vary depending on the field of its application and on the consumption of fluid medium per working stroke. The maximum volume of the chamber may be brought up to a few dozens of cubic meters, in this case the pressure in the chamber depends on the atmospheric pressure and on the pressure of the fluid medium in the supply system.

The fluid medium in this device may be either gas or liquid.

The efficiency of the claimed device can also be increased by reducing the energy consumption for bringing the sleeve to its initial position, which is determined by the work performed by the sleeve for displacement of the fluid medium from the chamber.

A significant advantage of the claimed device is that it is simple in design and operation, and has low weight and overall dimensions.

SUMMARY OF THE DRAWINGS

The invention is further described by way of example with reference to the accompanying drawings, in which.

PREFERRED EMBODIMENT OF THE INVENTION

The claimed device for converting energy of a fluid medium into mechanical work comprises a hermetically sealed chamber 1 (FIG. 1) for forcing the fluid medium, which is gas or liquid. The hermetically sealed chamber 1 is communicated through a control valve 2 with a system 3 for supplying the fluid medium (shown schematically in FIG. 1). Depending on the type of fluid medium and a required pressure in the chamber 1, the system 3 for supplying the fluid medium may be built around receivers of hydraulic pumps, and the control valve 2 for controlling the pressure or flow rate of the fluid medium.

Figure 1:
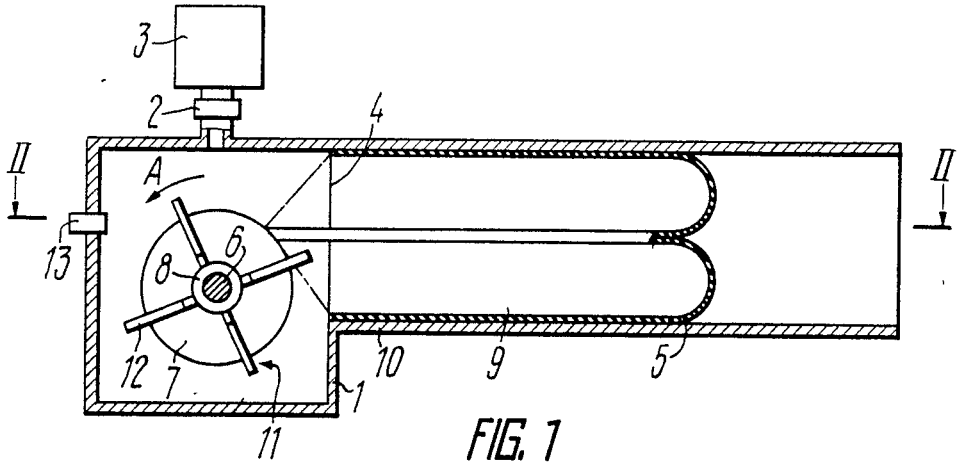
FIG. 1 shows a general view of the device for converting energy of a fluid medium into mechanical work (in a longitudinal section), according to the invention.

In the embodiment of the device for converting energy of a fluid medium into mechanical work shown in FIG. 1 the fluid medium is gas under pressure 0.5 to 0.7 mPa.

Made in one of the walls of the chamber 1 is an opening 4, in which, along the perimeter, there is fixed one end of a sleeve 5 made of a flexible material. The method of fixing of the sleeve 5 in the opening 4 depends on the maximum pressure of the fluid medium in the chamber 1 and on the material, of which the sleeve 5 is made. The sleeve 5 may be made of carbon plastics, woven polymer materials, polymer films, rubber. Its length depends on the required maximum volume of the chamber, which is determined by the output power of the device.

Mounted in the chamber 1 is a shaft 6, which is an actuator of the device. Mounted on the shaft 6 is a drum 7 coupled to the shaft through an overrunning clutch 8.

The sleeve 5 is mounted in the chamber 1 with a possibility of reciprocation with respect to its end fixed in the opening 4. The other end of the sleeve 5 is coupled to the drum 7. It can be directly secured on the drum 7 by any well known method depending on the material of the sleeve 5 and on the maximum torque transmitted by the sleeve 5 to the actuator.

In the initial position the sleeve 5 is wound on the drum 7. The initial position of the sleeve 5 in the chamber 1 is shown by a dot-and-dash line. In the extreme position a part of the sleeve 5 at its end fixed in the opening 4 is turned inside out, while the other part is disposed inside the sleeve 5 along the axis thereof. The space 9 formed when the sleeve 6 is moved to its extreme position, has an annular shape and is communicated with the chamber 1.

A branch pipe 10 made integral with the walls of the chamber 1 is used as a guide for the sleeve 5 during its motion.

The shaft 6 is connected to a reverser 11 through the overrunning clutch 8.

The reverse 11 in the described embodiment of the device for converting energy of a fluid medium into mechanical work comprises a group of blades 12 disposed radially at an equal distance from each other along a circle and secured on at least one end face of the drum 7. The discharge valve, through which the chamber 1 is communicated with the system for removing the fluid medium, is made as a throttle valve 13, while the fluid medium is exhausted into the atmosphere.

The throttle valve 13 is mounted in the wall of the chamber 1, opposite to the wall, wherein the sleeve 5 is fixed, and is arranged so that the stream of the fluid medium flowing through the throttle valve 13, acts on the blades 12 rotating the drum 7 for winding the sleeve 5.

The direction of rotation of the drum 7 when winding the sleeve 5 and during the movement to the initial position is shown by an arrow A.

The number of blades 12 secured on the end face of the drum 7 may be selected from three to twelve. This number depends on the gas pressure in the chamber 1, when the sleeve 5 is in its extreme position.

The blades 12 can also be secured on both ends of the drum 7. This is determined by the design of the device and also depends on the gas pressure in the chamber 1.

When the blades 12 are secured on both ends of the drum, the chamber 1 must be provided with two throttle valves 13 (FIG. 2) so that the stream of the fluid medium flowing through the second valve 13 acts on the blades 12 secured on the other end of the drum 7 thus also rotating it for winding the sleeve 5.

In order to control the operation of the throttle valves 13 and the control valve 2 (FIG. 1), the device includes two detectors 14 (FIG. 2) mounted in the branch pipe 10 and detecting the initial position of the sleeve and two detectors 15 detecting the extreme position of the sleeve.

Figure 3:
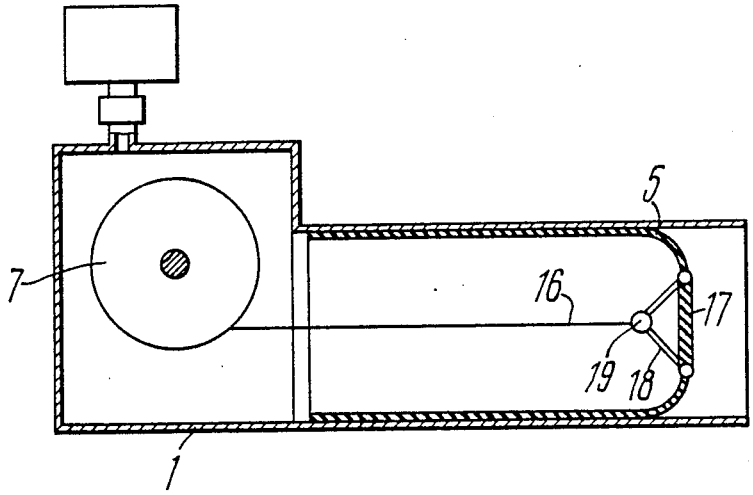
FIG. 3 is a general view of the device for converting energy of a fluid medium into mechanical work, having a flexible link connecting the drum to the end of the sleeve (in a longitudinal section), according to the invention.

In the device for converting energy of a fluid medium into mechanical work shown in FIG. 3 gas in the chamber 1 expands completely, i.e. to atmospheric pressure. To accelerate the discharge of gas from the chamber 1, the other end of the sleeve 5 in its extreme position is open and connected to the drum 7 through a flexible link 16 (FIG. 3) in the form of a rope and serves as a discharge valve. For this purpose, at this end of the sleeve 5 there is provided a ring 17, for example, made of rubber, and slings 18 disposed at the same distance from each other along the circle of the ring 17, each sling having one end connected to said ring. The other ends of the slings are interconnected forming a knot 19, which is connected to the flexible link 16. In the initial position (not shown) the flexible link 16 is wound together with the sleeve 5 on the drum 7. The reverse (not shown) in the claimed embodiment of the invention may be similar to that in the prior art device.

Figure 4:
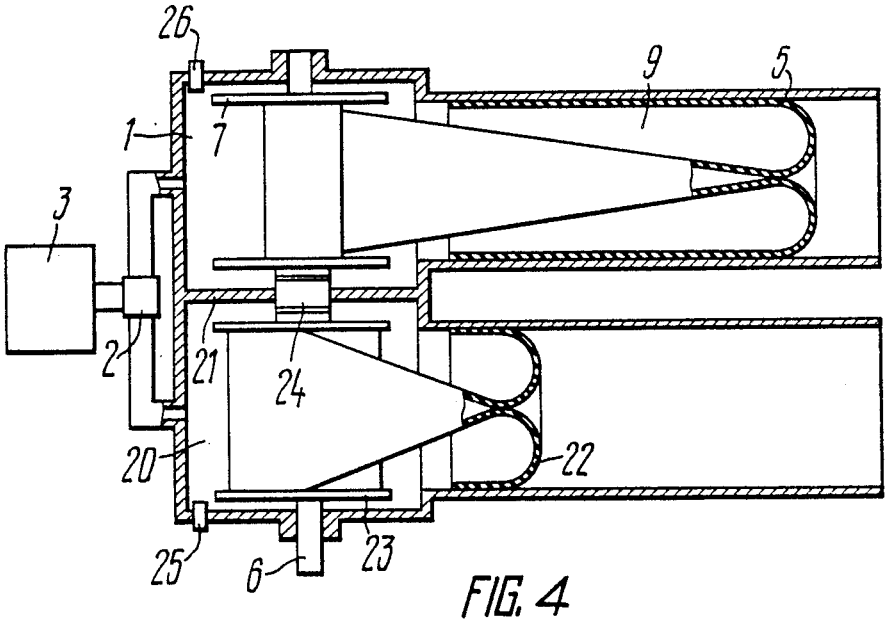
FIG. 4 is a general top view of the device for converting energy of a fluid medium into mechanical work with two chambers, in which the sleeves are wound on the drums in opposite directions (a longitudinal section), according to the invention.

The device for converting energy of a fluid medium into mechanical work in the embodiment shown in FIG. 4 comprises an additional hermetically sealed chamber 20 communicating through a control valve 2 with the system 3 for supplying the fluid medium similar to that shown in FIG. 1, made integral with the chamber 1 and separated from the main chamber 1 by a partition 21.

Mounted in the chamber 20, like the sleeve 5, is a sleeve 22 made of a flexible material of the same kind, of which the main sleeve 5 is made. In the initial position the sleeve 22 is wound on a drum 23, which is mounted on the same shaft 6 with the drum 7. The drums 7 and 23 are rigidly secured on the shaft 6 by means of a coupling 24. In this case the sleeve 5 and 22 are wound on the corresponding drums 7 and 23 in opposite directions.

Discharge valves 25 and 26 are mounted in the walls of the chambers 1 and 20 respectively.

In this device the shaft 6 capable of rotating in both directions can itself be used as a drive of, for example, hoisting mechanisms and sawing machines.

In the device, in which the shaft 6, serving as an actuator rotates in the same direction, the drums 7 and 23 are mounted on the shaft 6 by means of respective overrunning clutches 27 (FIG. 5) and 28 and a seal 29 mounted in the partition 21 between the chambers 1 and 20. The reverse 11 comprises two spools 30 and 31 rigidly secured on the drums 7 and 23 respectively, coaxially therewith, and a flexible link 32 whose ends are secured on the spools 30 and 31 and wound on the spool 30 disposed in the chamber 1 whose sleeve 5 is in the extreme position. In this case the link 32 must be long enough so as to provide a required travel of the sleeves 5 and 22 from the extreme position to the initial one. The sleeves 5 and 22 are wound respectively on the drums 7 and 23 in the same direction. The link 32 passes through two openings made in the chambers 1 and 20, said opening having seals 33 and 34; then the link passes over a roller 35 mounted outside the chambers 1 and 20.

In addition, the device has two springs 36 and 37 mounted on the shaft 6 at the end faces of the drums 7 and 23 for pressing the drums to the clutches 28 and 27 respectively.

The claimed device for converting energy of a fluid medium into mechanical work operates and follows.

A portion of gas is fed into the chamber 1 (FIG. 1) through the control valve 2 from the system 3 for supplying the fluid medium. Gas supplied under pressure of 0.5 to 0.7 MPa expands in the chamber and exerts pressure on the sleeve 5 being in the initial position thereby moving it to the extreme position. A part of the sleeve starts turning inside out to form a space 9 increasing in the process of unwinding of the sleeve 5 off the drum 7 and moving it to the extreme position, in which case the pressure in the chamber 1 drops down to 0.2 MPa. The motion of the sleeve 5 results in rotation of the drum 7, which, in turn, transmits a torque through the overrunning clutch 8 to the shaft 6, which is an actuator. Then the reverser 11 moves the sleeve 5 to its initial position. As soon as the sleeve 5 reaches the extreme position, the detectors 15 (FIG. 2) operate and send a signal for opening the throttle valves 13, through which gas is discharged from the chamber 1 into the atmosphere. Under the effect of the gas stream flowing from the throttle valve 13 the blades 12 rotate the drum 7 in the direction shown by the arrow A thus winding the sleeve 5 on the drum. In so doing, the overrunning clutch 8 (FIG. 1) operates and no torque is transmitted to the shaft 6. As soon as the sleeve 5 returns to the initial position, the detectors 14 (FIG. 2) operate and send a control signal for closing the throttle valves 13 and for opening the control valve 2. The next portion of gas is supplied into the chamber 1, and the operating cycle is repeated. The power output of such a device is determined by the cross-sectional area of the space 9 and gas pressure in the chamber 1 and can be as high as several dozens MW. The efficiency of this device comes up to 50%, since the maximum losses are associated with bending of the sleeve 5 during its reciprocation.

Figure 2:
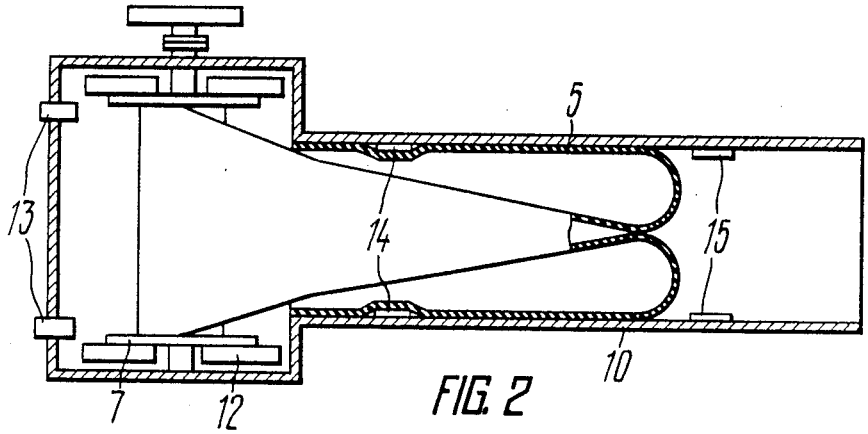
FIG. 2 is cross-sectional view taken along the line II—II in FIG. 1, according to the invention.

The device shown in FIG. 3 operates similarly to that shown in FIGS. 1, 2, except for the fact that the sleeve 5 during its motion to the extreme position is turned inside out practically completely. In this position of the sleeve gas is rapidly discharged from the chamber 1 through the ring 17 and the pressure inside the chamber 1 is reduced to atmospheric; therefore, less energy is consumed by the reverser 11 (FIG. 1) for bringing the sleeve 5 to the initial position and the sleeve 5 returns to its initial position faster. In this case the rotational speed of the actuator, i.e. shaft 6, increases.

The device shown in FIG. 4 operates as follows. From the system 3 for supplying the fluid medium, e.g. centrifugal pump, the liquid (water) is continuously supplied through the control valve 2 into the chamber 20 moving the sleeve 22 from the initial position to the extreme one. The sleeve unreeling from the drum 23 rotates it clockwise. The torque is transmitted to the shaft 6, which is an actuator. In this case the discharge valve 25 is closed.

When the sleeve 22 is in its initial position, the sleeve 5 is in the extreme position and the discharge valve 26 is open. As soon as the sleeve 22 starts to rotate the shaft 6, i.e. starts moving to its extreme position, the sleeve 5 starts moving from the extreme position to the initial one and winding onto the drum 7 in the direction opposite to the direction of winding of the sleeve 22.

The liquid from the space 9 formed by the sleeve 5 is displaced by the sleeve 5 through the discharge valve 26 into a fluid medium drain system, e.g. a liquid storage tank.

After the sleeve 5 returns to its initial position and the sleeve 22 is brought back to the extreme position, the discharge valve 26 closes, the discharge valve 25 opens and the control valve 2 is switched to a position, in which the system 3 for supplying the fluid medium is communicated with the chamber 1. In this case the sleeve 5 performs a working stroke similar to the working stroke of the sleeve 22 transmitting a torque to the shaft 6 and rotating it counterclockwise.

The shaft 6 rotating the drum 23 moves the sleeve 22 to its initial position.

Thus, the idle stroke of the working member is eliminated, which increases the device efficiency.

Figure 5:
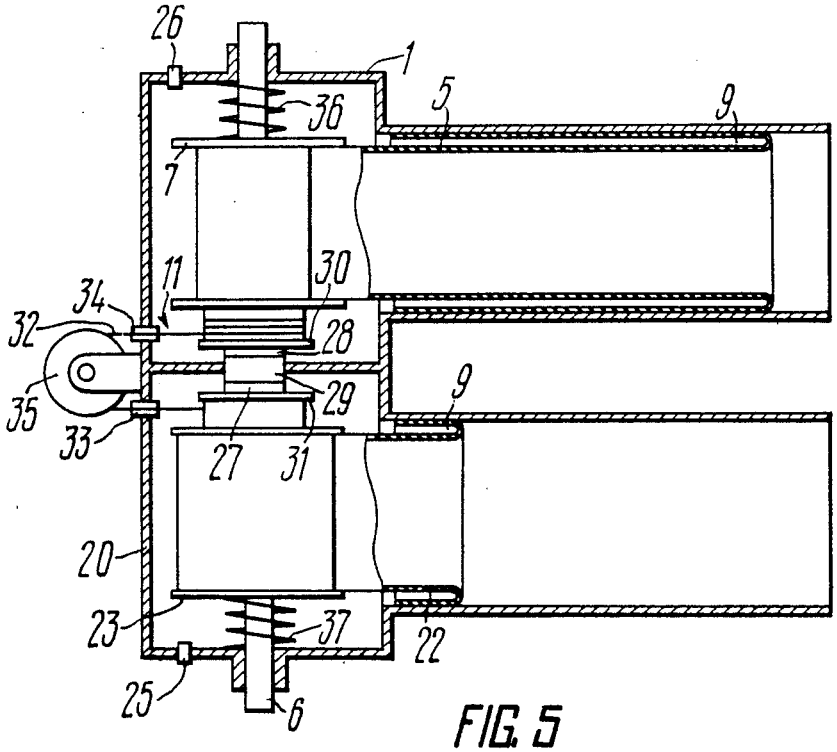
FIG. 5 is the same as in FIG. 4, with the sleeves wound on the drums in the same direction, according to the invention.

The device for converting energy of a fluid medium into mechanical work shown in FIG. 5 rotates the shaft 6 in the same direction with a constant torque and operates as follows. The fluid medium, e.g. compressed gas, is first fed into the chamber 20 whose sleeve 22 is in the initial position. In this case the discharge valve 25 is closed, the discharge valve 26 is open, and the sleeve 5 is in the extreme position. Expanding gas moves the sleeve 22 to the extreme position. The sleeve 22 rotates the drum 23, which transmits the torque through the overrunning clutch 27 to the shaft 6 rotating it counterclockwise. The spool 31 rotates together with the drum 23. The spool 31 reels up the flexible link 32 while unwinding it from the spool 30 and rotating it together with the drum 7 clockwise. In so doing, the overrunning clutch 28 operates and the torque of the drum 7 is no longer transmitted to the shaft 6. The drum 7 rotates and reels up the sleeve 5 thus moving it to the initial position. The sleeve 5 moving to the initial position displaces gas from the chamber 1 into the atmosphere through the discharge valve 26. After the sleeve 5 has moved to the initial position and the sleeve 22 has moved to the extreme position, the discharge valve 26 is closed, while the discharge valve 25 is opened, and the control valve 2 (not shown) is switched to a position, in which the system 3 for supplying the fluid medium is communicated with the chamber 1.

In this cause the sleeve 5 performs a working stroke similar to the working stroke of the sleeve 22 thus transmitting the torque from the drum 7 to the shaft 6 thus rotating it counterclockwise, i.e. in the same direction, in which the sleeve 22 is rotated.

In doing so, the flexible link 32 is unwound from the spool 31 thus rotating the drum 23 clockwise and moving the sleeve 22 to the initial position. The link 32 itself is wound on the spool 30. The overrunning clutch 27 operates and the torque is no longer transmitted from the drum 23 to the shaft 6.

Then the operating cycle is repeated.

INDUSTRIAL APPLICABILITY

The devices for converting energy of a fluid medium into a mechanical work can be used in various fields of industry and national economy as stationary engines, such as, for example, drives of metal working machines, or vehicle engines.

We claim:

1. A device for converting energy of a fluid medium into mechanical work comprising a hermetically sealed chamber (1) communicating through a control valve and a discharge valve with systems for supply and removal of the fluid medium and having an opening (4) fixed wherein along the perimeter thereof is one end of a sleeve (5) made of a flexible material and reciprocatingly mounted in the chamber (1) with respect to the fixed end so that, when traversing from the initial position to the extreme position, a part of a sleeve (5) is turned inside out forming a space (9), which sleeve (5) is connected to a drum (7) mounted on the shaft (6) which is coupled to a reverser (11) through an overrunning clutch (8), characterized in that the drum (7) is located inside the chamber (1), the other end of the sleeve (5) is connected to the drum (7) so that in the initial position the sleeve (5) is wound onto the drum (7) and the space (9) formed by the part of the sleeve (5) turned inside out communicates with the chamber (1).

2. A device for converting energy of a fluid medium into mechanical work, according to claim 1, characterized in that it comprises a flexible link (16) connected to the drum (7) and to the other end of the sleeve (5), which in the extreme position is open, while in the initial position is wound on the drum (7) together with the link (16).

3. A device for converting energy of a fluid medium into mechanical work, according to claims 1 or 2, characterized in that the reverser (11) comprises a group of blades (12) arranged radially and secured at least on one end face of the drum (7), while the discharge valve is made as a throttle valve (13) installed in a wall of the chamber (1) in such a manner that the stream of the fluid medium flowing from the chamber (1) through the throttle valve (13) acts on the blades (12) thus rotating the drum (7) for winding the sleeve (5).

4. A device for converting energy of a fluid medium into mechanical work according to any of the claims 1, or 2, characterized in that it includes an additional hermetically sealed chamber (20) communicating with the control valve (2) in which chamber an additional sleeve (22) made of an elastic material is mounted similarly to the main sleeve (5), so that in the extreme position of the main sleeve (5) the additional sleeve (22) is in its initial position and wound on an additional drum (23) mounted on the same shaft (6) on which the main drum (7) is mounted.

5. A device for converting energy of a fluid medium into mechanical work according to claim 4, characterized in that the main drum (7) and the additional drum (23) are rigidly interconnected, whereas the main sleeve (5) and the additional sleeve (22) in their initial position are wound on the corresponding drums (7, 23) in opposite directions.

6. A device for converting energy of a fluid medium into mechanical work comprising a hermetically sealed chamber (1) communicating through a control valve and a discharge value with systems for supply and removal of the fluid medium and having an opening (4) fixed wherein along the perimeter thereof is one end of a sleeve (5) made of a flexible material and reciprocatingly mounted in the chamber (1) with respect to the fixed end so that, when traversing from the initial position to the extreme position, a part of the sleeve (5) is turned inside out forming a space (9), which sleeve (5) is connected to a drum (7) mounted on a shaft (6) which is coupled to a reverser (11) through an overrunning clutch (8), characterized in that the drum (7) so that in the initial position the sleeve (5) is wound onto the drum (7) and the space (9) formed by the part of the sleeve (5) turned inside out communicates with the chamber (1) there is an additional hermetically sealed chamber (20) communicating with the control valve (2) in which chamber an additional sleeve (22) made of an elastic material is mounted similarly to the main sleeve (5), so that in the extreme position of the main sleeve (5) the additional sleeve (22) is in its initial position and wound on an additional drum (23) mounted on the same shaft (6) on which the main drum (7) is mounted; the main drum (7) is mounted on the shaft (6) by means of an overrunning clutch (28), while the device includes an additional overrunning clutch (27), through which the additional drum (230 is mounted on the shaft (6), whereas the reverser (11) comprises two spools (30 and 31) rigidly secured on the main drum (7) and the additional drum (23) coaxially therewith, and a flexible link 32, having its ends secured on the spools (30 and 31), and wound on the spool (30) secured on the drum (7) connected to the sleeve (5) when the sleeve (5) is in its extreme position, the main sleeve (5) and the additional sleeve (22) in their initial position being wound on the drums (7 and 23) in the same direction.

7. A device for converting energy of a fluid medium into mechanical work, comprising:

a hermetically sealed chamber having a periphery;

a drum rotatably mounted in said chamber;

a shaft in said chamber for rotatably mounting said drum therein;

a reverser connected to said drum;

means for supplying a fluid medium into said chamber;

a sleeve of flexible material fixed along its periphery to the hermetically sealed chamber and connected to said drum so as to be wound and unwound from said drum;

an additional hermetically sealed chamber;

a second drum rotatably mounted in said additional chamber on said shaft; and

An additional sleeve of flexible material having a periphery connected to said additional chamber and connected to said second drum for winding and unwinding thereon.

8. A device according to claim 7, further including an overrunning clutch for mounting said first-mentioned drum on said shaft and an additional overrunning clutch for mounting said second drum on said shaft; and wherein said reverser includes two spools rigidly secured on the first-mentioned drum and the second drum coaxially therewith, and a flexible link having opposite ends secured on the spools.

* * * * *